US012392040B2

(12) United States Patent
Waldfried et al.

(10) Patent No.: US 12,392,040 B2
(45) Date of Patent: Aug. 19, 2025

(54) METAL BODY HAVING MAGNESIUM FLUORIDE REGION FORMED THEREFROM

(71) Applicant: ENTEGRIS, INC., Billerica, MA (US)

(72) Inventors: Carlo Waldfried, Middleton, MA (US); Bryan C. Hendrix, Danbury, CT (US)

(73) Assignee: ENTEGRIS, INC., Billerica, MA (US)

( * ) Notice: Subject to any disclaimer, the term of this patent is extended or adjusted under 35 U.S.C. 154(b) by 924 days.

(21) Appl. No.: 17/125,539

(22) Filed: Dec. 17, 2020

(65) Prior Publication Data

US 2021/0198788 A1 Jul. 1, 2021

Related U.S. Application Data

(60) Provisional application No. 62/954,798, filed on Dec. 30, 2019.

(51) Int. Cl.

| | |
|---|---|
| ***C23C 8/06*** | (2006.01) |
| ***C22C 21/08*** | (2006.01) |
| ***C23C 22/02*** | (2006.01) |
| ***C23C 22/73*** | (2006.01) |
| *C23C 22/56* | (2006.01) |
| *C23C 22/57* | (2006.01) |

(52) U.S. Cl.
CPC ..... *C23C 22/02* (2013.01); *C22C 21/08* (2013.01); *C23C 22/73* (2013.01)

(58) Field of Classification Search
CPC ..... C23C 22/34; C23C 8/06
See application file for complete search history.

(56) References Cited

U.S. PATENT DOCUMENTS

| | | | | |
|---|---|---|---|---|
| 5,756,222 | A | 5/1998 | Bercaw | |
| 5,811,195 | A | 9/1998 | Bercaw | |
| 6,215,806 | B1 | 4/2001 | Ohmi et al. | |
| 7,393,765 | B2 | 7/2008 | Hanawa | |
| 8,293,658 | B2 | 10/2012 | Shero | |
| 10,913,202 | B2 | 2/2021 | Espalin et al. | |
| 11,318,532 | B2 | 5/2022 | Anthony et al. | |
| 11,807,946 | B2 | 11/2023 | Biener et al. | |
| 2002/0104590 | A1 | 8/2002 | Harenski et al. | |
| 2005/0058848 | A1 | 3/2005 | Hodgens et al. | |
| 2010/0080903 | A1 | 4/2010 | Tamitsuji | |
| 2010/0096044 | A1* | 4/2010 | Misawa | C23C 8/34 148/240 |
| 2013/0095380 | A1 | 4/2013 | Affinito | |
| 2016/0273095 | A1 | 9/2016 | Lin et al. | |

(Continued)

FOREIGN PATENT DOCUMENTS

| | | | |
|---|---|---|---|
| CN | 103341625 | B | 5/2015 |
| CN | 109423641 | A | 3/2019 |

(Continued)

OTHER PUBLICATIONS

Lea, C. et al.; Magnesium diffusion, surface segregation and oxidation in Al—Mg alloys; Chapman and Hall Ltd. 1984.

(Continued)

*Primary Examiner* — Lois L Zheng

(57) ABSTRACT

Described are metal bodies made of magnesium-containing metal and having a magnesium fluoride surface passivation region formed at a surface of the body, as well as methods of forming a magnesium fluoride surface passivation region at a surface of a metal body, and uses for the bodies.

12 Claims, 6 Drawing Sheets

(56) References Cited

U.S. PATENT DOCUMENTS

| | | | |
|---|---|---|---|
| 2017/0182558 | A1 | 6/2017 | Shimizu et al. |
| 2017/0370005 | A1 | 12/2017 | Mironets et al. |
| 2018/0068890 | A1 | 3/2018 | Zope |
| 2018/0135157 | A1 | 5/2018 | Jeong |
| 2018/0202047 | A1 | 7/2018 | Lin |
| 2018/0214953 | A1 | 8/2018 | Knittel et al. |
| 2019/0040529 | A1 | 2/2019 | Verbaas et al. |
| 2019/0085478 | A1 | 3/2019 | Burks et al. |
| 2019/0312202 | A1 | 10/2019 | Yokoyama |
| 2020/0079966 | A1 | 3/2020 | Holt et al. |
| 2020/0254547 | A1 | 8/2020 | Puidokas et al. |
| 2020/0324470 | A1 | 10/2020 | Walker |
| 2020/0397542 | A1 | 12/2020 | Andersen et al. |
| 2021/0198788 | A1 | 7/2021 | Waldfried et al. |
| 2022/0181124 | A1 | 6/2022 | Duan et al. |
| 2022/0251699 | A1 | 8/2022 | Miyaishi et al. |
| 2023/0093910 | A1 | 3/2023 | Waldfried |
| 2024/0401197 | A1 | 12/2024 | Wu et al. |

FOREIGN PATENT DOCUMENTS

| | | | | | |
|---|---|---|---|---|---|
| CN | 110352106 | A | | 10/2019 | |
| CN | 109112595 | A | | 6/2020 | |
| CN | 109940163 | B | | 12/2020 | |
| CN | 112675362 | A | | 4/2021 | |
| CN | 220069926 | U | | 11/2023 | |
| EP | 460700 | A | | 12/1991 | |
| JP | S57117992 | A | | 7/1982 | |
| JP | H0466657 | A | | 3/1992 | |
| JP | H04120728 | A | | 4/1992 | |
| JP | H 09-298329 | | * | 11/1997 | ..... H01S 3/036 |
| JP | 2986859 | B2 | | 12/1999 | |
| JP | 2003119540 | A | | 4/2003 | |
| JP | 2008041701 | A1 | | 4/2008 | |
| JP | 2010037581 | A | | 2/2010 | |
| JP | 2019218620 | A | | 12/2019 | |
| KR | 20160145652 | A | | 12/2016 | |
| KR | 20230007495 | A | | 1/2023 | |
| WO | WO-2008041701 | A1 | * | 4/2008 | ..... C23C 8/42 |
| WO | 2019194869 | A2 | | 10/2019 | |
| WO | 202014287 | A2 | | 1/2020 | |
| WO | 2020257488 | A1 | | 12/2020 | |
| WO | 2023079831 | A1 | | 5/2023 | |

OTHER PUBLICATIONS

Li Bo, 3D Printing Technology, China Light Industry Press, 2017 (Chinese only).

J. Dong et al., Extrusion-based 3D printed magnesium scaffolds with multifunctional MgF2 and MgF2-CaP coatings, The Royal Society of Chemistry, Biomaterials Science, vol. 9, pp. 7159-7182, 2021.

* cited by examiner

METAL BODY HAVING MAGNESIUM FLUORIDE REGION FORMED THEREFROM

CROSS-REFERENCE TO RELATED APPLICATION

This application claims the benefit of and priority to U.S. Provisional Application No. 62/954,798, filed on Dec. 30, 2019, which is incorporated by reference herein in its entirety for all purposes.

TECHNICAL FIELD

The present disclosure relates to metal bodies made of magnesium-containing metal and having a magnesium fluoride surface passivation region formed at a surface of the metal body, uses of those metal bodies, as well as methods of forming a magnesium fluoride surface passivation region at a surface of a metal body.

BACKGROUND

Semiconductor and microelectronic device manufacturing methods require various processing steps that involve highly reactive process materials such as plasmas. Example processes that use reactive process materials include plasma etching steps, plasma deposition steps and plasma cleaning steps. These processes are performed at an interior of a process chamber that contains a workpiece and the reactive process materials. The process chamber also includes various structures and components (a.k.a. "process chamber components") that define the process chamber and items internal to the process chamber that are required for operation. These may include chamber walls, flow conduits (e.g., flow lines, flow heads, piping, tubing, and the like), fasteners, trays, supports, and other structures that are used to support a workpiece or to deliver or contain reactive process materials relative to the process chamber.

For use as part of a process chamber, a process chamber component should be resistant to the reactive process materials that will be used within the process chamber. The process chamber components should not become degraded or damaged by contact with the process materials, especially in a manner that would produce debris or particulates that may become incorporated into the process that is being performed and potentially contaminate a workpiece being processed.

Process chamber components used in semiconductor processing equipment for manufacturing semiconductor and microelectronic devices are frequently made of a solid material (a "substrate" or a "base") such as a metal (e.g., stainless steel, aluminum alloy which may optionally be anodized, tungsten), a mineral, or ceramic material, etc. The substrate is usually coated with a protective layer that is more resistant to reactive process materials than is the substrate material. In the past, such protective thin film coatings or layers have typically been placed onto a substrate by various useful methods, typically by processes of anodizing (e.g., to produce anodized aluminum), spray coating, or physical vapor deposition (PVD).

SUMMARY

The following described disclosure relates to metal bodies that are made of magnesium-containing metal and that have a magnesium fluoride surface passivation region formed at a surface of the metal body. The disclosure also relates to methods of forming a magnesium fluoride surface passivation region at a surface of a metal body, to articles and structures that include a metal body having a magnesium fluoride surface passivation region at a surface, and to methods of using the described articles and structures.

The method involves forming the magnesium fluoride region within the metal body by a chemical reaction between a fluorine source and magnesium that is present in the magnesium-containing metal of the metal body. The metal body may be made of any metal that contains at least a small amount of magnesium. Examples include aluminum alloys, magnesium-alloys, stainless steel, stainless magnesium, and alloys of other metals such as vanadium, chromium, zinc, titanium, and nickel.

The method is distinct from previous methods that deposit a layer or coating of protective material generated separately, onto a surface of the metal body. In specific, the method is not performed by placing a coating or a layer that contains an exogenous protective material onto the surface, such by a deposition method, for instance by a chemical vapor deposition method, a physical vapor deposition method, an atomic layer deposition method, or any similar method or a modification of any of one of these. Instead, the described method forms the magnesium fluoride layer from magnesium that is originally present within the metal substrate (i.e., endogenous magnesium), and from fluorine that is provided separately (i.e., exogenous fluorine).

Additionally, the methods do not involve using or forming plasma as part of a method of forming magnesium fluoride at a metal body surface. The methods, as described herein, involve forming magnesium fluoride by exposing a metal body surface to a molecular fluorine vapor source at elevated temperature. These non-plasma methods are capable of producing a highly conformal magnesium fluoride surface passivation region that has a uniform thickness on all exposed surfaces of the metal body, including features that have a high aspect ratio (e.g., holes, channels, internal plenums, metal membranes). Example metal bodies may include high aspect ratio features having an aspect ratio of at least 20:1, 50:1, 100:1, 200:1, or even 500:1.

The magnesium fluoride surface passivation region provides chemical inertness and resistance to chemical degradation. A metal body having the magnesium fluoride surface passivation region at a surface can be useful in any application for which a chemically inert surface is useful or desired. Examples include as a protective surface of a piece of manufacturing equipment, such as a coating of a component of a semiconductor processing tool. Semiconductor processing tool components are commonly made of aluminum, e.g., aluminum 6061. For such use, the surface of the aluminum requires a protective surface treatment, which, typically, may be by anodization, application of a protective spray coating, or a protective coating deposited by physical vapor deposition, atomic layer deposition, chemical vapor deposition, or the like. Examples include oxides such as alumina, yttria, zirconia, etc. Exemplary coatings include fluorides such as $AlF_3$ or $YF_3$, which may be more stable and may provide relatively greater etch and corrosion resistance. But fluorides are more difficult to form.

Described herein are methods that are effective to form a magnesium fluoride surface passivation region at a metal surface, as well as metal bodies that include useful magnesium fluoride surface passivation regions, as well as articles, equipment, and methods that involve the metal bodies. The magnesium fluoride surface passivation region may appear in the form of a continuous or a discontinuous layer formed within the metal body at the surface of the metal body.

In one aspect, the disclosure relates to an aluminum alloy body having a surface and a magnesium fluoride surface passivation region at the surface. The aluminum alloy includes at least 93 weight percent aluminum; magnesium, and at least 0.5 weight percent non-magnesium impurities.

In another aspect, the disclosure relates to a metal body that includes a magnesium-containing metal alloy region and a magnesium fluoride surface passivation region at a surface. The magnesium-containing metal alloy contains less than 95 weight percent aluminum.

In yet another aspect, the disclosure relates to a method of forming a magnesium fluoride surface passivation region at a surface of a magnesium-containing metal substrate. The method includes exposing the surface to molecular fluorine source vapor at elevated temperature to from a continuous or discontinuous region of magnesium fluoride at the surface of the magnesium-containing metal substrate.

BRIEF DESCRIPTION OF THE DRAWINGS

The disclosure may be more completely understood in consideration of the following description of various illustrative embodiments in connection with the accompanying drawings.

Figure 1:
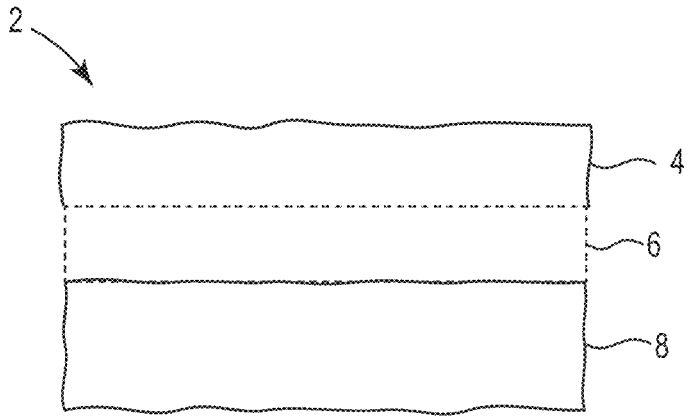
FIG. 1 is a schematic representation of a magnesium fluoride surface passivation region formed at a surface of a metal body in accordance with various embodiments of the disclosure.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DETAILED DESCRIPTION

The following description relates to metal bodies made of magnesium-containing metal and having a magnesium fluoride surface passivation region formed at a surface of the body; to methods of forming a magnesium fluoride surface passivation region at a surface of a metal body; to articles, devices, and equipment that include a metal body having a magnesium fluoride surface passivation region at a surface, such as a process chamber component of semiconductor manufacturing equipment; and to related methods of use.

FIG. 1 is a schematic representation of a metal body 2 having a magnesium fluoride surface passivation region 4 formed at a surface of the metal body as described herein according to the various embodiments. According to various embodiments, a magnesium fluoride surface passivation region 4 is formed at a surface of a metal body 2 made of a magnesium-containing metal thereby passivating the surface of the metal body 2. As used herein, a magnesium-containing metal is defined as any metal or metal alloy that contains an amount of magnesium. The magnesium fluoride surface passivation region 4 is formed at the surface of the metal body 2 by exposing the surface to a molecular fluorine source at an elevated temperature in a manner by which fluorine of the molecular fluorine source reacts with magnesium that is present in the metal of the metal body 2 to form the magnesium fluoride surface passivation region 4. As a result, the metal body 2 includes a magnesium fluoride surface passivation region 4 formed at a surface of the metal body 2, a bulk region 8 comprised of the magnesium-containing metal, and a transition region 6 between the surface passivation region and the bulk region. The transition region 6 has a ratio of magnesium fluoride to the magnesium containing metal that gradually increases in a direction from the bulk region 8 to the magnesium fluoride surface passivation region 4.

Advantageously, as compared to other conventional methods of adding a chemically-resistant coating material on a surface of a solid body, a magnesium fluoride surface passivation region as described may be formed at (including below) the surface of the metal body from magnesium that is originally present in the metal of the metal body, i.e., from endogenous magnesium. During the reaction, the magnesium contained within the magnesium-containing metal body may travel along the metal grain boundaries to the surface to form the magnesium fluoride passivation region at the surface of the metal body. The magnesium fluoride passivation region is not a coating or layer that is applied to the surface as a composition or material added to the surface by a coating or another deposition technique such as by chemical vapor deposition, physical vapor deposition, atomic layer deposition, or the like. Instead, the magnesium fluoride that becomes part of the magnesium fluoride surface passivation region at the surface is a reaction product of fluorine from a molecular fluorine source that is exposed to the metal body surface, reacted with magnesium that is originally present in the magnesium-containing metal. The magnesium fluoride surface passivation region may be a continuous region covering an entire surface of the metal body from which it is formed, or the magnesium fluoride surface passivation region may be a discontinuous region covering only a portion of the metal body from which it is formed. The magnesium fluoride surface passivation region formed at the surface of the metal body passivates the surface of the metal body.

Additionally, a magnesium fluoride surface passivation region according to the present disclosure is different from reaction products that are chemically formed at a surface of a process chamber component during use of the process chamber component, or in a pre-use "seasoning" step, including such layers that may include magnesium fluoride. Certain uses of semiconductor processing equipment involve exposing process chamber components that are operatively installed within a processing tool and performing a function of the tool, to reactive process materials such as fluorine in the form of plasma, during use of the processing tool. Fluorine of the plasma can contact the process chamber component during use of the tool, potentially forming magnesium fluoride at a surface.

Methods of forming a magnesium fluoride surface passivation region on a process chamber component or other metal body of the present disclosure are different from previous types of "in-use" formation. As one difference, the presently-described methods are not performed within a semiconductor processing tool during use of the tool, with the process chamber component being an installed, operational component of the processing tool. The presently-described methods form the magnesium fluoride surface passivation region on a process chamber component that is not operatively installed in a process tool during use, but that is contained and supported in a non-functioning manner in a different type of process chamber, one that is adapted to perform the step of forming magnesium fluoride on the process chamber component surface. Additionally, the presently-described methods of forming a magnesium fluoride surface passivation region do not use plasma as a fluorine source, but instead use molecular fluorine as a fluorine source, and may be performed at different time, pressure, and temperature conditions, e.g., in the presence of non-plasma materials such as air along with the molecular fluorine source vapor. Furthermore, certain structural and compositional differences can also exist between the process chamber components having a magnesium fluoride surface passivation region that are formed during use of a semiconductor processing tool, and metal bodies prepared to include a magnesium fluoride surface passivation region by a method of the present disclosure.

The magnesium-containing metal on which the magnesium fluoride surface passivation region is formed may be referred to herein as a "metal body" or a "substrate." Forming a magnesium fluoride surface passivation region at the "surface" of the metal body refers to forming magnesium fluoride at a surface of exposed metal of the body, as well as below the surface. It is understood that the composition of the exposed metal includes magnesium, but also that the exposed metal surface may include metal oxide compounds formed by exposure of the surface to oxygen. The type and amount of metal oxide compounds may be consistent with a naturally-oxidized surface of the metal alloy. Preferred oxidation at the surface may be of a type and degree that will not interfere with desired formation of magnesium fluoride at the surface by a process as described. Preferably, any oxidation present at the surface can be formed naturally and not by a deliberate chemical oxidization process such as by anodizing or otherwise chemically or electrochemically treating the surface to intentionally form metal oxide at the surface.

Useful methods of forming a magnesium fluoride surface passivation region as described herein include methods of exposing a surface of a magnesium-containing metal body to molecular fluorine source vapor at a temperature that causes fluorine of the molecular fluorine source vapor to react with magnesium that is originally present in the metal of the metal body, to form magnesium fluoride at (including below) the surface. As used herein, a "molecular fluorine source vapor" is a non-plasma (i.e., molecular) chemical molecule that is in vapor (gaseous) form, that is not considered a plasma. A "plasma" is a non-solid, vapor phase composition that contains a high density of ionic fragments derived from one or more plasma precursor compounds that have been deliberately exposed to energy (e.g., from a radio frequency power source) for the purpose of breaking down the plasma precursor compound into the ions, to use the ions for processing a workpiece. In contrast to a plasma, a useful or preferred molecular fluorine source vapor may contain less than 10E-6 atomic percent ionized materials, such as less than 10E-6 atomic percent ionic species.

A molecular fluorine source vapor may be provided to a process chamber for forming a magnesium fluoride surface passivation region by any method or from any useful and effective source or location. In preferred methods, molecular fluorine source vapor may be produced in situ, meaning during a process of forming a magnesium fluoride surface passivation region on a surface of a magnesium metal-containing body, and within the process chamber used for forming the magnesium fluoride surface passivation region on the surface. The molecular fluorine source vapor may be generated in situ from a non-gaseous fluorine source by heating the non-gaseous fluorine source to cause molecules of the non-gaseous fluorine source to become gaseous, i.e., a molecular vapor. The non-gaseous fluorine source may be a liquid or solid fluorine-containing substance, and the heating step produces the gaseous form of the molecules without causing significant degradation or ionization of the molecules of the liquid or solid fluorine source. In some embodiments, gaseous form of the molecules may be at least 99.9999 atomic percent molecular, i.e., non-chemically-changed molecules of the liquid or solid fluorine-containing substance; may contain less than 10E-6 atomic percent ionized or degraded materials, such as less than 10E-6 atomic percent ionic species.

The heating step that produces a molecular fluorine source vapor that is distinct from a step of generating plasma, which is used in various semiconductor processing steps. In general, plasma-generating steps involve applying one or more forms of energy to a plasma source, which is generally a gaseous chemical substance, to ionize the plasma source and chemically degrade molecules of the plasma source to produce ionic fragments of the molecules. The energy may be heat energy (elevated temperature), electromagnetic radiation such as RF (radiation produced by a radio frequency power source), or combinations of these.

As a specific comparison, a heating step of the present disclosure used to produce a molecular fluorine source vapor is different from a step of generating fluorine-containing plasma for use in a semiconductor processing tool for a step of plasma etching, plasma cleaning, or "seasoning" a process chamber of a semiconductor processing tool. An example of a plasma-generating step that is different from the presently-described heating step is described in U.S. Pat. No. 5,756,222, which describes a fluorine-containing plasma generated in a reaction chamber designed for a plasma etch or plasma cleaning process. The plasma is prepared by exposing a fluorine precursor to RF power.

A method of the present disclosure for forming a magnesium fluoride surface passivation region at a surface of a magnesium-containing metal body can be performed in a process chamber, at elevated temperature, by: locating the metal body within the process chamber in a removable, temporary, non-operational manner; dispensing molecular fluorine source vapor into the process chamber, or generating molecular fluorine source vapor within the process chamber by heating non-gaseous fluorine source to cause molecules of the non-gaseous fluorine source to become gaseous, i.e., a vapor, within the process chamber; and elevating the temperature of the process chamber, metal body, molecular fluorine source vapor, or a combination thereof to cause a reaction between fluorine of the molecular fluorine source vapor with magnesium present at the surface of the metal body to form a magnesium fluoride surface passivation region at the surface of the metal body.

During a step of forming the magnesium fluoride surface passivation region, the process chamber may contain processing materials that include the molecular fluorine source vapor, optionally a non-vapor fluorine source, and one or more magnesium-containing metal bodies, each having a surface at which will be formed a magnesium fluoride surface passivation region. The interior space and atmosphere of the chamber need not be evacuated or at a reduced pressure, and may contain an amount of atmospheric air. There is no need to eliminate air or oxygen, or to introduce an inert gas (purge gas, e.g., $N_2$) into the process chamber for the forming step. The process chamber need not contain and may exclude any other additional gaseous or liquid processing materials besides air and the molecular fluorine source vapor, e.g., may exclude other gaseous materials such as an inert gas or a gaseous co-reactant, which may sometimes be used in a gaseous atmosphere of other semiconductor processing steps.

The process chamber is not part of a semiconductor processing tool and need not contain and preferably does not contain any other workpiece such as a semiconductor device or precursor thereof that is being otherwise processed. The process chamber also does not require and does not involve the use of a means for generating plasma, such as a radio frequency power source or means for applying an electrical potential (voltage) to a component or workpiece.

A useful process chamber can preferably include: temperature control to control temperature within the chamber; means to control the composition and purity of the environment interior to the chamber, such as pressure controls, filters, etc.; components to temporarily contain and support one or multiple metal bodies within the chamber for a period of forming the magnesium fluoride surface passivation region on the bodies; and components to control the composition of an atmosphere within the process chamber, including to supply and control the amount and concentration the molecular fluorine source within the process chamber. A useful process chamber does not require and my exclude means for generating plasma, such as a radio frequency power source.

According to certain embodiments, a molecular fluorine source vapor can be a gaseous fluorinated or perfluorinated organic compound such as a fluorinated or perfluorinated alkane or alkene, any of which may be straight or branched. Examples include $CF_4$, $C_2F_4$, $C_3F_6$, $C_4F_8$, $CHF_3$, $C_2H_2F_2$, $C_2F_6$, HF, $CH_3F$, among others, each in a molecular form, meaning substantially non-ionic and not processed (by adding energy other than heat) to degrade or form plasma.

According to other embodiments, a molecular fluorine source vapor can be a gaseous fluorinated polymer that has not been processed with energy to form plasma. A gaseous fluorinated polymer can be derived from a non-gaseous (e.g., liquid or solid) fluorinated polymer by heating the non-gaseous fluorinated polymer, for example in a process chamber and in the presence of a surface of a magnesium-containing metal body at which magnesium fluoride is desired to be formed.

The fluorinated polymer may be any fluorinated polymer that will be effective according to a method as described, for forming a magnesium fluoride surface passivation region at a surface of a magnesium-containing metal body. Examples of useful fluorinated polymers include homopolymers and copolymers that include polymerized fluoroolefin monomers and optional non-fluorinated co-monomers. A polymer may be fluorinated (i.e., partially fluorinated), perfluorinated, or may include non-fluorine halogen atoms such as chlorine. A molecular fluorine source may be liquid or solid at room temperature, but will become a vapor at a temperature of a process chamber used according to a method as described.

Non-limiting examples of specific fluoropolymers include: polymerized perfluoroalkylethylene having a $C_1$-$C_{10}$ perfluoroalkyl group; polytetrafluoroethylene (PTFE); tetrafluoroethylene/perfluoro(alkyl vinyl ether) copolymer (PFA); tetrafluoroethylene/hexafluoropropylene copolymer (FEP); tetrafluoroethylene/perfluoro(alkyl vinyl ether)/hexafluoropropylene copolymer (EPA); polyhexafluoropropylene; ethylene/tetrafluoroethylene copolymer (ETFE); poly trifluoroethylene; polyvinylidene fluoride (PVDF); polyvinyl fluoride (PVF); polychlorotrifluoroethylene (PCTFE); ethylene/chlorotrifluoroethylene copolymer (ECTFE); or a combination thereof.

A step of forming a magnesium fluoride surface passivation region as described can be performed at any temperature that is effective to cause fluorine from the fluorine source vapor to react with magnesium at a surface of the magnesium-containing metal body. A relatively high elevated temperature is generally useful or preferred, with a temperature range including temperatures that may be at least as high as or higher than example or typical temperatures used in some types of semiconductor processing steps, such as deposition steps, plasma etching steps, and plasma cleaning steps. Example temperatures may be at least 200, 250, 300, or 350 degrees Celsius, or higher, e.g., a temperature in a range from 350 to 500, such as from 375 or 400 to 425 or 450 degrees Celsius.

The process chamber can be operated at any useful pressure, with example pressures being approximately atmospheric (760 Torr), e.g., from 100 to 1500 Torr, such as from 250 or 500 to 1000 or 1250 Torr. The atmosphere within the process chamber for forming the magnesium fluoride on a metal body may include a portion that is air, in combination with the molecular fluorine source vapor.

An amount of time used to form a magnesium fluoride surface passivation region at a surface of a metal body by a method as described can be based on factors such as temperature, the type and amount (concentration) of molecular fluorine source vapor in the process chamber, the type of magnesium-containing metal, and the desired thickness of the magnesium fluoride passivation region. Example amounts of time that are useful may be in a range of from 1 to 15 hours, e.g., from 2 to 13 hours, or from 3 to 12 hours. A useful time can be a period of time that produces a magnesium fluoride passivation region of a useful or preferred thickness. The thickness will increase over time, with continued exposure of the metal body to the molecular fluorine source vapor, but after a certain amount of time, e.g., after 12 hours, the thickness of the magnesium fluoride passivation region no longer continue to increase.

As used herein, the term "region" in describing a "region" of magnesium fluoride formed at a surface of a metal body refers to a portion of the metal body at and beneath a surface of the metal body, and that contains magnesium fluoride, optionally at a designated minimum concentration. The region can be a discontinuous or a continuous region. A concentration of magnesium fluoride in a magnesium fluoride passivation region may be high, for example at least 50, 70, 90, or 90 percent, and typically will be higher or highest at the surface, and may become gradually lower with increasing distance from the surface. Compared to being formed on top of a surface of the metal body, forming the magnesium fluoride passivation region at and beneath the surface can advantageously eliminate certain difficulties that are involved in forming or placing a protective coating on top of a surface, such as: substrate surface cleanliness, substrate surface conditioning (prior to coating), mismatched coefficients of thermal expansion (CTE) of a coating material and a substrate, adhesion of a coating to a surface, interface engineering, etc.

A magnesium fluoride passivation region can be formed to any useful or desired thickness below the surface of the metal body The depth (thickness) to which magnesium fluoride is formed below the surface can be affected by factors such as time and temperature of formation, the type of molecular fluorine source, and the chemical composition of the metal body (for example its magnesium content). A useful or preferred thickness of the magnesium fluoride passivation region may be in a range of from 1 to 200 nanometers, such as from 5 to 150 nanometers, or from 25 to 130 nanometers, as measured by the presence of a concentration of magnesium fluoride to a designated depth below a surface, for example a concentration of at least 10, 20, 40, 50 percent magnesium fluoride.

Thickness of the magnesium fluoride passivation region based on a concentration of magnesium fluoride measured at a designated depth (thickness) can be measured by known techniques; thickness may be measured or estimated by use of: SEM (scanning electron microscope) cross-section; XPS (x-ray photoelectron spectroscopy) depth profiling; and EDAX (energy disruptive x-ray microanalysis) techniques.

During formation of the magnesium fluoride passivation region, magnesium within the bulk metal region of the metal body travels along the metal grain boundaries towards a surface of the metal body. This results in a metal body having three regions including the magnesium fluoride surface passivation region, a bulk region comprised of the magnesium containing metal or metal alloy (e.g. aluminum alloy), and a transition region between the magnesium fluoride surface passivation region and the bulk region. According to various embodiments, the transition region has a ratio of magnesium fluoride to the magnesium containing metal that gradually increases in a direction from the bulk region to the magnesium fluoride surface passivation region. In some cases, the thickness of the magnesium surface passivation region can be measured from a point within the transition region where a ratio of the magnesium fluoride to the magnesium containing metal in the metal body is approximately 50:50.

The magnesium fluoride passivation region is effective as a chemically resistant layer of a process chamber component or other article or device that may desirably include a chemically-resistant surface. Useful magnesium fluoride passivation regions exhibit advantageous levels of resistance to process materials used in a process chamber of a semiconductor processing tool, including but not limited to acids and plasmas, especially over extended periods of exposure. In other uses, a magnesium fluoride passivation region may protect a surface from oxidation of the metal alloy in an atmosphere of use that may include a biological environment (such as for a surface of a medical implant) or in an ambient air atmosphere.

In the context of a semiconductor processing tools, a "resistant" coating is a coating that, upon exposure to a process material such as an acid, base, gas plasma, or other reactive chemical material, in a process chamber of a semiconductor processing tool, during use, especially extended use over a period of weeks or months, experiences a commercially useful, low amount of degradation or chemical change, including, preferably, an amount that is consistent with or reduced relative to other protective coatings that have been used previously, for example relative to previous coatings used in process chambers of semiconductor processing tools, example coatings including yttria or alumina coatings applied by physical vapor deposition (PVD) or atomic layer deposition (ALD), and aluminum oxide layers formed by anodization. Preferred magnesium fluoride surface passivation regions of the present disclosure can have advantageously long useful lifetimes as a protective coating in a process chamber of a semiconductor processing tool, most preferably a useful lifetime that is significantly greater than the mentioned previous protective coatings. Degradation or lack of degradation of a magnesium fluoride surface passivation region as described may be measured using any of various techniques commonly used in the protective coating arts, including visual means such as optical or scanning electron microscopy wherein areas of cracks, fissures, or other defects are examined.

Magnesium fluoride surface passivation regions, as described herein, may be useful with other product structures and types, different from process components of semiconductor processing tools, such as medical devices or implants, airplane or other vehicle parts, or other structural or functional devices, articles, or structures, that have a surface that preferably is inert in a relevant environment of use, over time, e.g., will not degrade or oxidize, or otherwise react with or in the environment.

Useful magnesium fluoride surface passivation regions, described herein, can also be temperature resistant over extended periods of time, including during use at high temperatures (e.g., in a range from 350 to 500 degrees Celsius) in a semiconductor processing tool. More generally, a useful or preferred magnesium fluoride surface passivation region can be resistant to thermal degradation for extended periods of time at temperatures of up to or in excess of 200, 300, 400, 450, or 500 degrees Celsius. Relative to other types of protective coatings deposited on a surface of a metal body, a magnesium fluoride surface passivation region of the present disclosure show improved resistance to high temperature by showing reduced cracking, blistering, or delamination, etc. due to CTE-induced thermal stresses and/or other mechanisms, when exposed to a high temperature (e.g., 200, 300, 400, 450, or 500 degrees Celsius) for an extended period of time.

A magnesium-containing metal within which a magnesium fluoride surface passivation region is formed as described herein may contain any amount of magnesium that will allow for magnesium fluoride ($MgF_2$) to form at a surface of a metal body when the metal body is processed by a method as described. A useful concentration of magnesium in a magnesium-containing metal may be as low as 0.01 weight percent or possibly lower, with a maximum concentration of essentially 100 percent magnesium. Example ranges may be from 0.01, 0.1, 0.5, 1, 3, or 5 weight percent up to or exceeding 80, 90, 95, or 99 weight magnesium based on total weight metal body.

Examples of useful magnesium-containing metals alloys include general and specific types that are known and useful in commercial and industrial devices and structures. These include pure magnesium, magnesium alloys that contain a relatively high amount of magnesium (e.g., greater than 50 percent by weight), as well as various other metal alloys that contain lower amounts of magnesium, e.g., below 50, 40, 30, 20, or 10 percent magnesium as elemental magnesium. A short list of examples includes stainless steel, aluminum alloys, vanadium alloys, magnesium alloys (e.g., "stainless magnesium"), other types of iron alloys, nickel alloys, chromium alloys, zinc alloys, among others.

Iron alloys, e.g., steel or stainless steel, which also contain at least a minor amount of magnesium, may be useful as a metal body. A steel alloy, e.g., stainless steel, may contain a mixture of the following: chromium (16.5-18.5 weight percent), nickel (10.5-13.5 weight percent), molybdenum (2.0-

2.5 weight percent), magnesium (e.g., at least 0.01, 0.1, or 1 percent by weight), carbon, and a balance of iron, each in elemental form.

Useful alloys of nickel, vanadium, chromium, aluminum, magnesium, zinc, titanium, or other metals, can include at least 40, 50, 60, 70, or 80 weight percent of a single such base metal, with known blends of additional metals, and with an amount of magnesium of at least 0.01, 0.1, or 1 percent by weight, each in elemental form.

Useful magnesium alloys may contain up to or more than 50, 60, 70, 80, 90, 95, or 99 weight percent magnesium. A particular type of useful magnesium alloy is sometimes referred to as "stainless magnesium," and contains a predominant amount (e.g., at least 50, 60, 70, 80, 90, 95, or 99 weight percent) of a combination of magnesium and lithium, or a combination of magnesium and aluminum. The magnesium is preferably not in the form of magnesium oxide. Preferred alloys can contain not more than an insubstantial amount of magnesium oxide (MgO), e.g., less than 1, 0.5, 0.1, or 0.05 weight percent magnesium oxide.

Useful alloys for the metal body also include aluminum alloys, which may include alloys that contain up to or in excess of 40, 50, 60, 70, 80, 90, 93, or 95 weight percent aluminum, an amount of magnesium, and non-magnesium elements such as one or a mixture of silicon, iron, copper, chromium, zinc, titanium, manganese, or other metals.

An example of an aluminum alloy, one that is used with process chamber components of semiconductor processing tools, is aluminum 6061, which may be considered to be an aluminum alloy that contains ingredients in amounts such as: at least 96, 97, 97.5 weight percent aluminum with the balance being magnesium (e.g., from 0.5 or 0.8, up to 1.2 weight percent), silicon (e.g., from 0.4 to 0.8 weight percent), iron (0.0 to 0.7 weight percent), copper (e.g., from 0.15 to 0.4 weight percent), chromium (e.g., from 0.04 to 0.35 weight percent), zinc (e.g., from 0.0 to 0.25 weight percent), titanium (e.g., from 0.0 to 0.25 weight percent) and manganese (e.g., from 0.0 to 0.15 weight percent). More particularly, an example of an aluminum alloy referred to as aluminum 6061 can contain about 98 weight percent aluminum, about 0.60 weight percent silicon, about 0.28 weight percent copper, about 1.0 weight percent magnesium, and about 0.2 weight percent chromium.

In aluminum alloys such as aluminum 6061 and similar aluminum alloys (e.g., other 6000 series aluminum alloys), amounts of metal components other than aluminum and other than magnesium can be any amounts, such those described herein. Such non-magnesium components of an aluminum alloy may be referred to as "non-magnesium impurities," or as "mobile impurities," and include metal species other than aluminum or magnesium that readily diffuse in the aluminum matrix. Such mobile impurities include metals, transition metals, semiconductors, and elements that can form semiconductor compounds such as gallium, antimony, tellurium, arsenic, and polonium; e.g., a mixture of silicon, iron, copper, chromium, zinc, titanium, manganese, or other metals. Methods of the present disclosure are effective for forming a useful magnesium fluoride surface passivation region at a surface of an aluminum alloy body even if the aluminum alloy contains a total amount of such impurities that is considered to be relatively high for aluminum 6061, for example even with a concentration of non-magnesium impurities or "mobile impurities" that is greater than 0.2, 0.5, 1.0, 1.5, 2.0, 2.5, 3.0 or 5.0 weight percent of the aluminum alloy.

A metal body as described, within which a magnesium fluoride surface passivation region may be formed, may typically include an amount of one or more metal oxides on a surface, formed from contact of the metal surface with atmospheric oxygen. An oxidized layer need not be present and may preferably be minimized. A sufficiently thin or dispersed oxidized layer will not unduly hinder or prevent formation of magnesium fluoride at an underlying metal alloy surface by exposure to a fluorine source. The metal oxide, particularly for an aluminum alloy such as aluminum 6061 or another 6000 series aluminum alloy, is preferably of a type that has not been artificially placed at the surface, for example by anodizing the surface.

Example thicknesses of naturally-occurring metal oxides will depend on various factors such as the particular conditions present during formation of the oxide and the type and particular composition of the alloy. For metal alloys generally, and particularly for an aluminum alloy such as aluminum 6061 or another 6000 series aluminum alloy, a thickness of metal oxide at the surface may be as low as 5, 10, or 100, or 500 angstroms, up to 1000 angstroms. Higher thicknesses are also possible, such as in a range of nanometers, e.g., up to 3, 5, or 10 nanometers, or even higher.

The naturally-occurring metal oxide will be present at a lower amount, and have a thickness that is less than a layer of metal oxide that has been artificially produced at an alloy surface, such as by anodization. For aluminum, an aluminum oxide layer formed by anodizing an aluminum surface (e.g., of aluminum 6061 or another 600 series aluminum alloy), may be in a range above 5 or 10 microns.

A metal body having a magnesium fluoride surface passivation region as described can be useful as part of any structure, device, article, or equipment that includes a surface that is desirably inert, chemical resistant, or otherwise stable in an environment of use. A metal body may be part of processing or manufacturing equipment, storage containers or storage equipment, a medical device such as a medical (biological) implant, a vehicle such as an airplane, etc.

In particular uses, a metal body having a magnesium fluoride surface passivation region as described can be useful with manufacturing or processing equipment that uses or operates within a liquid or gaseous environment that contains reactive chemical materials. One example of this type of equipment is a semiconductor processing tool.

Without limiting the scope of the present disclosure, a semiconductor processing tool typically may include a process chamber that is operated at a vacuum, within which a semiconductor substrate is processed. The process chamber operates at a high level of vacuum to contain and allow processing of a semiconductor substrate by exposing the substrate to highly pure process materials such as a plasma, ions, or molecular compounds in the form of a gas or vapor, which will be applied to the semiconductor substrate. The process chamber must contain components and surfaces that are useful to contain, transport, hold, secure, support, or move a substrate into, out of, and within the process chamber. The process chamber must also contain a system of structures that is effective to contain, deliver, generate, or remove processing materials (e.g., plasma, ions, gaseous deposition materials, etc.) relative to the process chamber. Examples of these different types of process chamber components include a sidewall or liner that defines an interior surface of a process chamber, as well as flow heads (shower heads), shields, trays, supports, nozzles, valves, conduits, stages for handling or holding a substrate, wafer handling fixtures, ceramic wafer carriers, wafer holders, susceptors, spindles, chucks, rings, baffles, and various types of fasteners (screws, nuts, bolts, clamps, rivets, etc.). Any of these or other types of process chamber components can be prepared in the form of a metal body with a magnesium fluoride surface passivation region formed at a surface thereof, as described herein.

A metal body that is useful as a process chamber component, or otherwise, may have any shape or any form of a surface, such as a flat and planar surface (for a liner or sidewall), or may additionally or alternately have a physical shape or form that includes an opening, aperture, channel, tunnel, a threaded screw, a threaded nut, a porous membrane, a filter, a three-dimensional network, a hole, or the like, including such features that are considered to have a high aspect ratio. Methods of forming a magnesium fluoride surface passivation region as described herein, by exposing a surface of a metal body to a molecular fluorine source at high temperature, can be effective to provide a uniform and high quality magnesium fluoride surface passivation region on such surfaces, including on components that have structures with an aspect ratio of at least 20:1, 50:1, 100:1, 200:1, or even 500:1.

A metal body having a magnesium fluoride surface passivation region as described may be useful with a process chamber component of any type of semiconductor processing tool, and with semiconductor processing tools that operate at any temperature and other process conditions.

Although the present disclosure refers often to the use of a magnesium fluoride surface passivation region on a metal body of a process chamber component used in a semiconductor manufacturing processes (e.g., ion implantation, deposition steps), with a semiconductor processing tool, the described metal bodies with a magnesium fluoride surface passivation region are not limited to these items and applications. Examples of other uses for solid bodies as described include use in other environments, e.g., at high vacuum environments, biological environments, or ambient (e.g., air) environments, to increase inertness and chemical resistance of a surface of a metal body.

EXAMPLES

Example 1

A magnesium fluoride surface passivation region was formed at a surface of an aluminum alloy (6061 Al) test coupon by exposing the test coupon to a fluorine-containing vapor at 400 degrees Celsius for approximately four hours. The test coupon was then evaluated using focused ion beam scanning electron microscopy (FIB SEM), X-ray powder diffraction (XRD) and X-ray photoelectron spectroscopy (XPS). The test coupon was also evaluated for its resistance to reactive ion etching (RIE-F) and its resistance to concentrated nitric acid ($HNO_3$).

Figure 2A:
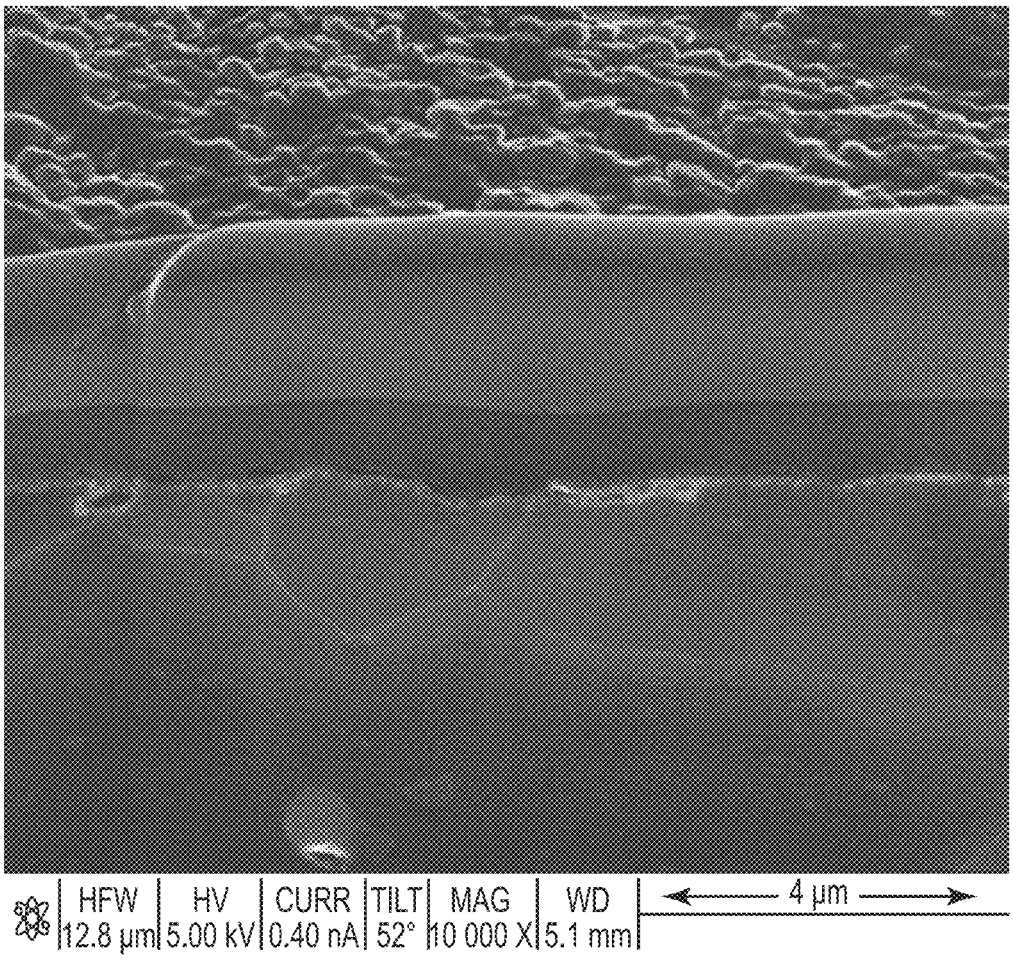
FIG. 2A is a FIB-SEM image of a cross-section of metal test coupon produced in accordance with an embodiment of the disclosure.

FIG. 2A is a FIB-SEM image of a cross-section of metal test coupon. Visible in the cross-section are a conductive coating 10 that is necessary to conduct the FIB-SEM analysis. The surface passivation region 12 including magnesium fluoride formed at the surface of the metal test coupon is present below the conductive coating 10. The thickness of the surface passivation region 12 within the metal test coupon is approximately 100 nm. Also visible are magnesium fluoride decorated grain boundaries 14 and a bulk region 16 including the aluminum alloy (6061 Al).

Figure 2B:
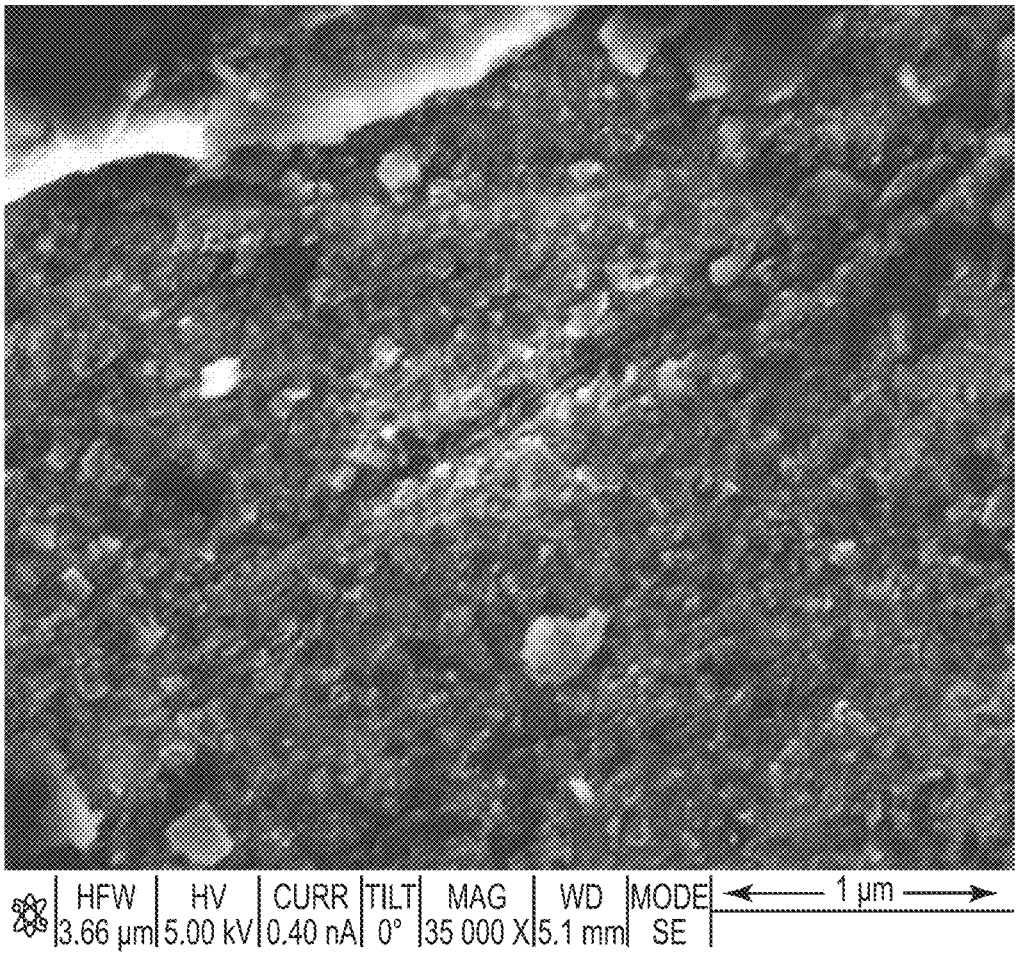
FIG. 2B is a top down image taken by FIB-SEM of the metal test coupon cross-section of FIG. 2A.

FIG. 2B is a top down image taken by FIB-SEM of the metal test coupon cross-section. Visible in the top down image are micro-crystallites ranging from about 50 to 100 nm in size.

Figure 3:
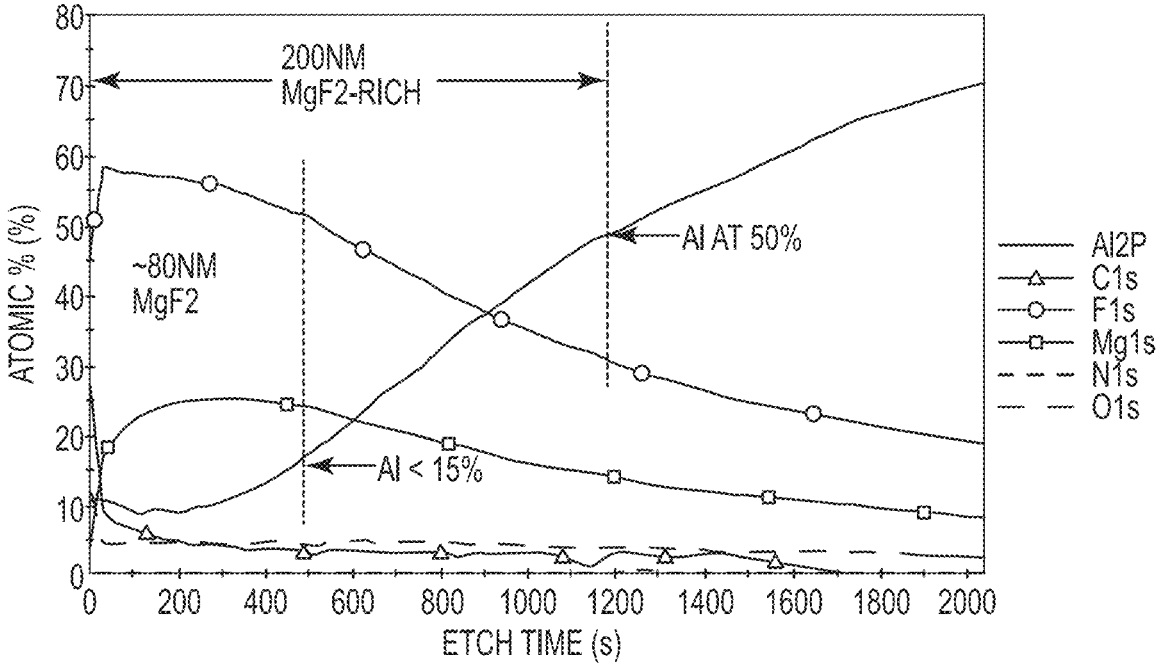
FIG. 3 is a X-ray photoelectron spectroscopy (XPS) depth profile of the composition of a metal test coupon produced in accordance with an embodiment of the disclosure.

X-ray photoelectron spectroscopy (XPS) and X-ray powder diffraction (XRD) were also used to evaluate the metal test coupon. The spectrum produced by XPS is shown in FIG. 3. As can be seen in the spectrum of FIG. 3, there is a very thin layer containing surface adventitious carbon and oxygen that is etched away in less than 10 seconds. The next 80 nm is $MgF_2$ with less than 15 at % Al. As the surface is etched deeper, the mixture of $MgF_2$ and Al becomes more Al-rich, reaching about 50 at % at a depth of 200 nm. As the surface is etched deeper still, the Al content increases and the F:Mg ratio stays near 2:1 indicating that $MgF_2$ is the primary state of Mg.

Figure 4:
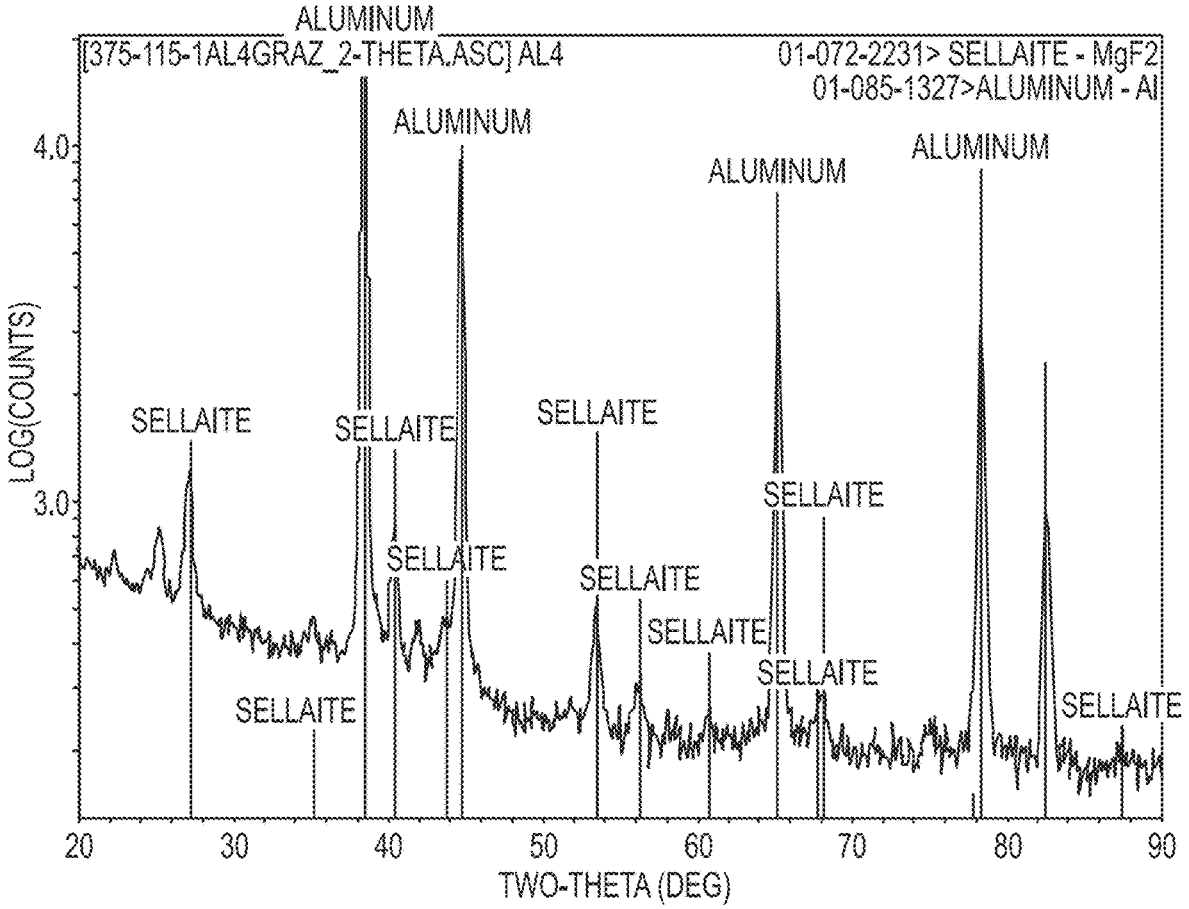
FIG. 4 is a X-ray diffraction (XRD) spectrum of a metal test coupon produced in accordance with an embodiment of the disclosure.

The XRD spectrum is shown in FIG. 4. The XRD spectrum shows aluminum and magnesium fluoride signatures that are consistent with the FIB-SEM and XPS analyses revealing that the magnesium fluoride in the surface passivation layer is polycrystalline and has the crystal structure consistent with sellaite ($MgF_2$), powder diffraction file 072-2231.

Figure 5:
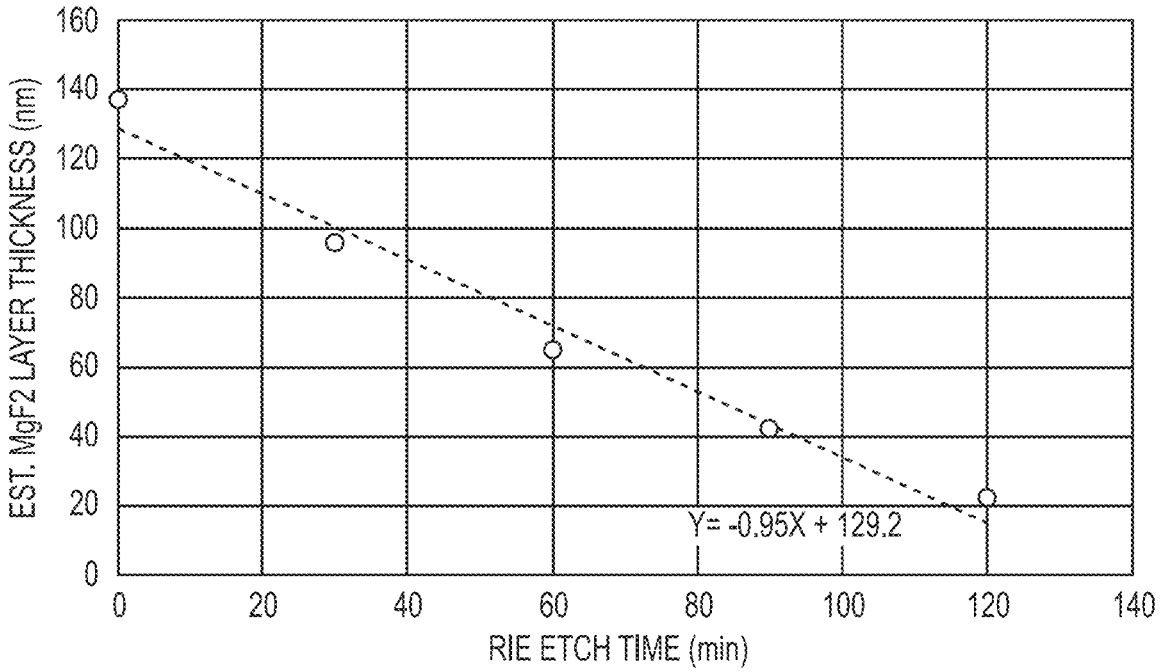
FIG. 5 is a graph showing the thickness of a magnesium fluoride surface passivation region formed at a surface of a metal test coupon as a function of etch time.

The test coupon was subjected to reactive ion etching (RIE-F). The thickness of the magnesium fluoride surface passivation region was plotted as a function of etch time to create the chart shown in FIG. 5. The data demonstrates that the etch rate of the magnesium fluoride surface passivation region formed at the surface of the 6061 aluminum test coupon is less than 1 μm/hour and in particular, is about 0.06 μm/hour.

Example 2

Test coupons of 6061Al were given different treatments to protect the surface. Each test coupon was then soaked in a concentrated $HNO_3$ solution and the solution was analyzed by ICP-MS for metals content. The metals content for the different test coupons subjected to the acid soak are shown in Table 1.

TABLE 1

| | | Test Coupons | | | |
|---|---|---|---|---|---|
| Element | Name | 6061 Al anodized (type II) | 6061 Al anodized (oxalic) | 6061 Al (untreated) | 6061 Al + MgF2 passivation region |
| Al | aluminum | 9537.52 | 716.72 | 5700.24 | 1141.43 |
| Bi | bismuth | 442.54 | 4.36 | 2.96 | 0.01 |
| Cr | chromium | 19.68 | 6.92 | 1.05 | 0.20 |
| Cu | copper | 434.27 | 1097.91 | 2288.33 | 1.04 |
| Fe | iron | 18.01 | 22.23 | 5.42 | 1.52 |
| Pb | lead | 1066.72 | 29.57 | 170.58 | 0.15 |
| Mg | magnesium | 89.98 | 75.35 | 6731.37 | 1.21 |
| Mn | manganese | 80.32 | 13.26 | 0.53 | 0.11 |
| Ti | titanium | 29.44 | 3.94 | 2.14 | 0.13 |
| V | vanadium | 13.70 | 1.01 | 0.38 | <.01 |
| Zn | zinc | 108.03 | 26.10 | 2.39 | 0.40 |

The data in Table 1 shows that the test coupon including the magnesium fluoride surface passivation region leached metals at a lower level than comparable test coupons anodized by either of two methods or the untreated test coupon. In particular, the test data reveals that the untreated 6061 Al test coupon leaches high levels of copper (Cu), lead (Pb), and magnesium (Mg) in addition to the expected leaching of aluminum (Al). Type II anodization improves the magnesium (Mg) leaching, but adds other unwanted impurities such as bismuth (Bi), chromium (Cr), iron (Fe), lead (Pb), manganese (Mn), titanium (Ti), vanadium (V), and zinc (Zn). Anodization with oxalic acid produces a cleaner surface than Type II, but still adds new impurities that are not present in the base metal. The magnesium fluoride surface passivation region is effective at lowering aluminum as well as eliminating almost all of the magnesium, copper and lead.

Having thus described several illustrative embodiments of the present disclosure, those of skill in the art will readily appreciate that yet other embodiments may be made and used within the scope of the claims hereto attached. Numerous advantages of the disclosure covered by this document have been set forth in the foregoing description. It will be understood, however, that this disclosure is, in many respect, only illustrative. Changes may be made in details, particularly in matters of shape, size, and arrangement of parts without exceeding the scope of the disclosure. The disclosure's scope is, of course, defined in the language in which the appended claims are expressed.

The invention claimed is:

1. A method of forming a magnesium fluoride surface passivation region at a surface of a metal body comprising: separately adding a solid fluorinated polymer and a magnesium-containing metal body to a process chamber; heating the solid fluorinated polymer to generate a molecular fluorine source vapor; exposing the magnesium-containing metal body to the molecular fluorine source vapor at a temperature of at least 200 degrees Celsius for a period of time ranging from 1 to 15 hours, wherein fluorine from the molecular fluorine vapor source reacts with magnesium within the magnesium-containing metal body to form the magnesium fluoride surface passivation region at the surface of the metal body at a desired thickness.

2. The method of claim 1, wherein the fluorinated polymer comprises: polymerized perfluoroalkylethylene having a $C_1$-$C_{10}$ perfluoroalkyl group; polytetrafluoroethylene (PTFE); a tetrafluoroethylene/perfluoro (alkyl vinyl ether) copolymer (PFA); a tetrafluoroethylene/hexafluoropropylene copolymer (FEP); a tetrafluoroethylene/perfluoro (alkyl vinyl ether)/hexafluoropropylene copolymer (EPA); polyhexafluoropropylene; an ethylene/tetrafluoroethylene copolymer (ETFE); poly trifluoroethylene; polyvinylidene fluoride (PVDF); polyvinyl fluoride (PVF); polychlorotrifluoroethylene (PCTFE); an ethylene/chlorotrifluoroethylene copolymer (ECTFE); or a combination thereof.

3. The method of claim 1, wherein the molecular fluorine source vapor comprises $CF_4$, $C_2F_4$, $C_3F_6$, $C_4F_8$, $CHF_3$, $C_2H_2F_2$, $C_2F_6$, HF, $CH_3F$, or a combination thereof.

4. The method of claim 1, comprising exposing the surface of the metal body to the molecular fluorine source vapor at a temperature of at least 350 degrees Celsius.

5. The method of claim 1, comprising exposing the surface to the molecular fluorine source vapor at the elevated temperature for a time period in a range from 3 hours to 12 hours.

6. The method of claim 1, wherein the magnesium-containing metal body comprises an aluminum alloy.

7. The method of claim 1, wherein the desired thickness of the magnesium fluoride surface passivation layer ranges from 1 to 200 nm.

8. The method of claim 1, wherein the surface of the magnesium-containing metal body comprises high aspect ratio features having an aspect ratio ranging from 20:1 to 500:1, and wherein the surface passivation region is formed such that it has a uniform thickness on the high aspect ratio features.

9. The method of claim 8, wherein the magnesium containing metal body is any one of an opening, an aperture, a channel, a tunnel, a threaded screw, a threaded nut, a porous membrane, a filter, or a three-dimensional network.

10. The method of claim 8, wherein the magnesium containing metal body is a three-dimensional network.

11. The method of claim 8, wherein the magnesium containing body is a porous membrane.

12. The method of claim 1, wherein the magnesium-containing body is a process chamber component.

* * * * *